US010114327B2

(12) United States Patent
Miyake et al.

(10) Patent No.: US 10,114,327 B2
(45) Date of Patent: Oct. 30, 2018

(54) IMAGE FORMING APPARATUS

(71) Applicant: CANON KABUSHIKI KAISHA, Tokyo (JP)

(72) Inventors: Toshiyuki Miyake, Abiko (JP); Satoru Yamamoto, Noda (JP); Katsuya Nakama, Nagareyama (JP); Koji Yumoto, Toride (JP); Riki Fukuhara, Kashiwa (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/226,071

(22) Filed: Aug. 2, 2016

(65) Prior Publication Data

US 2017/0045854 A1 Feb. 16, 2017

(30) Foreign Application Priority Data

Aug. 12, 2015 (JP) ..... 2015-159404

(51) Int. Cl.
*G03G 15/00* (2006.01)
*G03G 15/23* (2006.01)

(52) U.S. Cl.
CPC ..... *G03G 15/6567* (2013.01); *G03G 15/234* (2013.01)

(58) Field of Classification Search
CPC ..... G03G 15/6567
USPC ..... 399/395
See application file for complete search history.

(56) References Cited

U.S. PATENT DOCUMENTS

| | | | | |
|---|---|---|---|---|
| 4,657,239 | A * | 4/1987 | Ikesue | B65H 9/101 271/227 |
| 5,149,080 | A | 9/1992 | Yamamoto | |
| 5,348,287 | A | 9/1994 | Yamamoto et al. | |
| 5,588,758 | A | 12/1996 | Yamamoto | |
| 5,642,949 | A | 7/1997 | Yamamoto | |
| 7,878,496 | B2 | 2/2011 | Fujii et al. | |
| 8,038,139 | B2 | 10/2011 | Nishimura et al. | |
| 8,204,427 | B2 | 6/2012 | Yamamoto et al. | |
| 8,406,681 | B2 | 3/2013 | Miyake | |
| 8,561,978 | B2 | 10/2013 | Takahashi et al. | |
| 2007/0264066 | A1 * | 11/2007 | Peng | G03G 15/5062 399/395 |

(Continued)

FOREIGN PATENT DOCUMENTS

| | | | |
|---|---|---|---|
| JP | 2008-282003 | A | 11/2008 |
| JP | 2011-180412 | A | 9/2011 |

*Primary Examiner* — Anthony Nguyen
(74) *Attorney, Agent, or Firm* — Fitzpatrick, Cella, Harper & Scinto

(57) ABSTRACT

An image forming apparatus includes a fixing unit configured to fix a toner image to a sheet; a sheet moving motor configured to move the sheet in a width direction orthogonal to a conveyance direction of the sheet; and a controller configured to determine a movement amount of the sheet to be moved by the sheet moving motor for each sheet, wherein the controller sets a first movement amount for a first sheet when an image is formed on a first side of the first sheet, the controller sets a second movement amount for a second sheet when an image is formed on a first side of the second sheet, and controls the sheet moving motor such that the first sheet is moved in the width direction by the first movement amount when an image is formed on a second side of the first sheet.

9 Claims, 7 Drawing Sheets

(56) References Cited

U.S. PATENT DOCUMENTS

| | | | | |
|---|---|---|---|---|
| 2008/0056790 | A1* | 3/2008 | Maruyama | G03G 15/6564 399/395 |
| 2010/0061783 | A1* | 3/2010 | Kawasaki | B65H 9/002 399/381 |
| 2010/0283199 | A1* | 11/2010 | Yasumoto | B65H 7/06 271/227 |
| 2011/0243618 | A1* | 10/2011 | Nakamura | G03G 15/1605 399/308 |
| 2012/0286468 | A1* | 11/2012 | Ui | B65H 7/06 271/228 |
| 2014/0086596 | A1* | 3/2014 | Izumiya | G03G 15/1615 399/12 |
| 2015/0023711 | A1* | 1/2015 | Kawanago | G03G 15/6567 399/394 |
| 2015/0071692 | A1* | 3/2015 | Maruta | B65H 3/0669 399/361 |

* cited by examiner

| SHIFT POSITION | NUMBER OF SUPPLIED SHEETS |
|---|---|
| +2 | 15016 |
| +1 | 15012 |
| 0 | 15013 |
| −1 | 15013 |
| −2 | 15015 |

| SHIFT POSITION | NUMBER OF SUPPLIED SHEETS |
|---|---|
| +2 | 15016 |
| +1 | 15014 |
| 0 | 15013 |
| −1 | 15013 |
| −2 | 15015 |

IMAGE FORMING APPARATUS

BACKGROUND OF THE INVENTION

Field of the Invention

The present invention relates to an image forming apparatus configured to form images on both sides of a sheet.

Description of the Related Art

In recent years, in image forming apparatus particularly for production use, in a job for forming images on both sides of a sheet, alignment (registration) accuracy of duplex printing for front and back sides is required to be enhanced.

Meanwhile, along with enhancement of accuracy of a conveyance position of the sheet, when edges of the sheets are successively conveyed through the same position of a fixing roller in an axial direction, a surface of the fixing roller may be flawed by cut edges (cut end surfaces) of the sheets. In U.S. Pat. No. 8,204,427, there is described an image forming apparatus, in which, in order to prevent the flaw on the fixing roller, which may be generated by the cut edges of the sheets, the sheet is moved in a direction orthogonal to a conveyance direction on an upstream side of a transfer position, and an image writing start position on a photosensitive member is set in accordance with the shift position.

Further, in Japanese Patent Application Laid-Open No. 2011-180412, there is described an image forming apparatus in which, in the job for forming the images on both the sides of the sheet, shift positions of a first side and a second side are set different from each other, thereby preventing the flaw on the fixing roller.

The shift position of the sheet when the sheet is moved in the direction orthogonal to the conveyance direction of the sheet as described in U.S. Pat. No. 8,204,427 or Japanese Patent Application Laid-Open No. 2011-180412 is determined based on a step angle, a speed reduction ratio, or the number of input steps of a positioning motor of a shift mechanism or other factors. The movement amount of the sheet is computed based on the number of input steps, which are required for moving the sheet to the shift position, and the image writing start position is set in accordance with the movement amount, thereby being capable of performing alignment of an image with respect to the sheet.

However, in actuality, an error occurs for each shift position of the sheet due to, for example, the circularity or the eccentricity of a timing pulley among mechanical components to be used in the above-mentioned shift mechanism. As a result, the positional relationship between the sheet and the image varies for each shift position. When the shift positions of the first side and the second side vary from each other, the alignment accuracy between front and back in the duplex printing may be degraded.

SUMMARY OF THE INVENTION

In view of the above, the present invention provides an image forming apparatus capable of enhancing alignment accuracy between a position of an image on a first side of a sheet and a position of an image on a second side of the sheet even when the sheet is moved in a width direction orthogonal to a conveyance direction.

According to one embodiment of the present invention, there is provided an image forming apparatus operable in a simplex image forming mode for forming an image on a first side of a sheet and in a duplex image forming mode for forming images on the first side of the sheet and a second side of the sheet, which is reverse to the first side, the image forming apparatus comprising:

a toner image forming unit configured to form a toner image on an image bearing member;

a sheet conveying unit configured to convey the sheet;

a transfer unit configured to transfer the toner image, which is formed on the image bearing member, onto the sheet conveyed by the sheet conveying unit;

a fixing unit configured to fix, to the sheet, the toner image transferred on the sheet;

a sheet reversing unit configured to reverse the first side and the second side of the sheet, the toner image having been fixed to the first side, and to convey the sheet to the transfer unit again in the duplex image forming mode;

a sheet moving motor configured to move the sheet in a width direction orthogonal to a conveyance direction of the sheet to be conveyed to the fixing unit so as to change a position of the sheet in the width direction; and a controller configured to determine a movement amount of the sheet to be moved by the sheet moving motor for each sheet, wherein, when an image is to be formed on a first side of a first sheet, the controller sets a first movement amount for the first sheet, wherein, when an image is to be formed on a first side of a second sheet, the controller sets a second movement amount for the second sheet, and wherein, when an image is to be formed on a second side of the first sheet, the controller controls the sheet moving motor such that the first sheet is moved in the width direction by the first movement amount.

Further features of the present invention will become apparent from the following description of exemplary embodiments with reference to the attached drawings.

DESCRIPTION OF THE EMBODIMENTS

Figure 1:
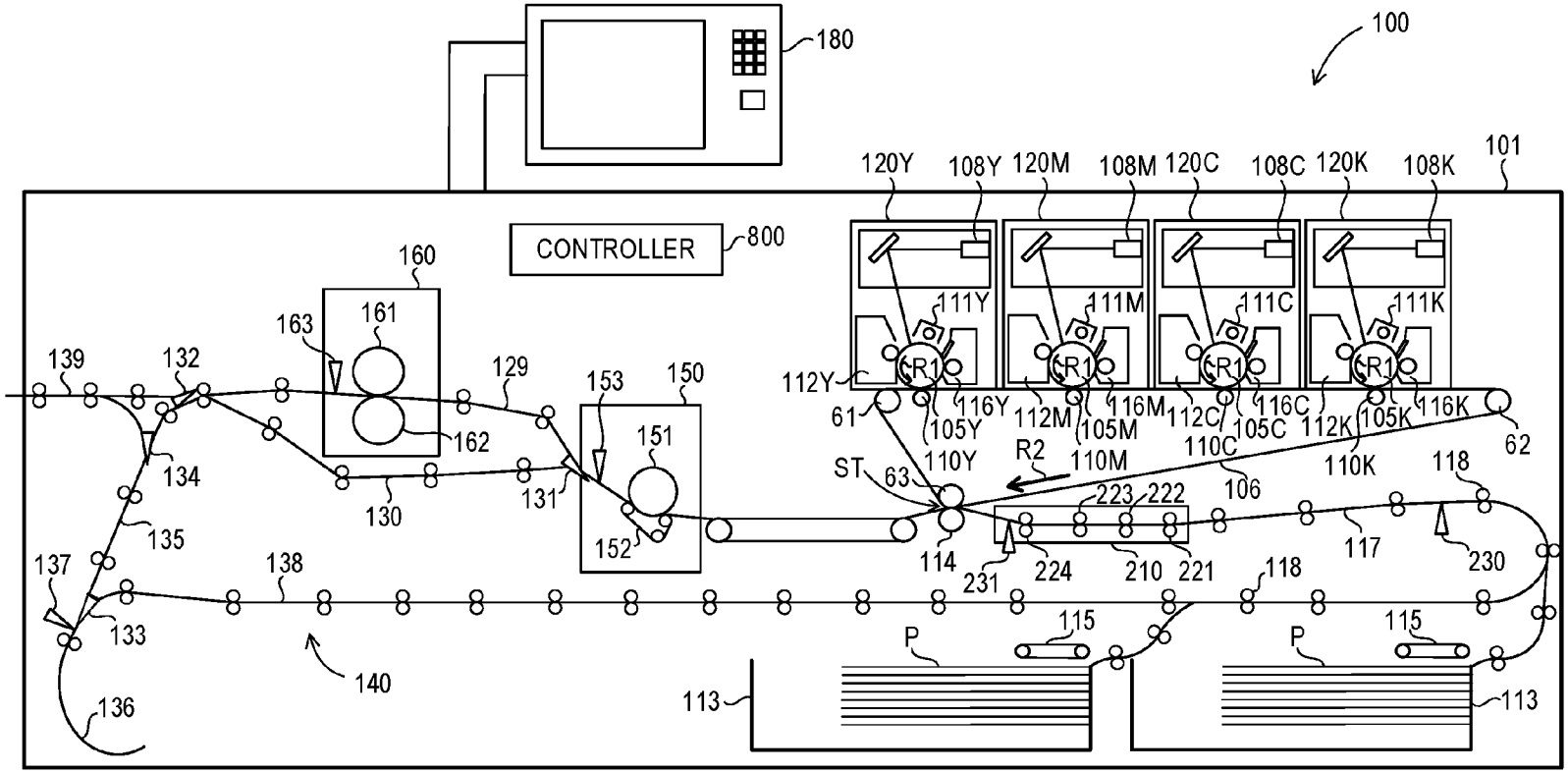
FIG. 1 is a sectional view of an image forming apparatus.

Embodiments of the present invention will be described below with reference to the accompanying drawings. FIG. 1 is a sectional view of an image forming apparatus 100. The image forming apparatus 100 is an electrophotographic image forming apparatus. Here, the electrophotographic image forming apparatus is configured to form an image on a recording medium (hereinafter referred to as "sheet") P using an electrophotographic image forming process. As the electrophotographic image forming apparatus, for example, there are known an electrophotographic copying machine (such as digital copying machine), an electrophotographic printer (such as color laser beam printer and color LED printer), a multifunction peripheral (MFP), a facsimile machine, a printing machine, and a word processor. The electrophotographic image forming apparatus not only encompasses an image forming apparatus configured to form a monochrome image but also encompasses a color image forming apparatus. In this case, the embodiment will be described based on an electrophotographic color laser beam printer as the image forming apparatus 100. Note that, the image forming apparatus 100 is not limited to the electrophotographic method, but may also employ other image forming methods.

The image forming apparatus 100 includes a main body 101 and an operation unit 180. As illustrated in FIG. 1, the image forming apparatus 100 includes four image forming portions 120 (120Y, 120M, 120C, and 120K). The image forming portions 120 are each a toner image forming unit configured to form a toner image using developer (toner). The image forming portion 120Y is configured to form a yellow toner image using yellow toner. The image forming portion 120M is configured to form a magenta toner image using magenta toner. The image forming portion 120C is configured to form a cyan toner image using cyan toner. The image forming portion 120K is configured to form a black toner image using black toner. The suffixes Y, M, C, and K of the reference symbols indicate yellow, magenta, cyan, and black, respectively. The four image forming portions 120 have the same structure except for the colors of the toner, and hence, in the following description, the suffixes Y, M, C, and K are omitted from reference symbols unless otherwise necessary.

The image forming portions 120 each include a photosensitive drum (photosensitive member) 105 serving as an image bearing member. The photosensitive drum 105 is rotatable in a direction indicated by the arrow R1. Around the photosensitive drum 105, there are disposed a charging device 111, a light scanning device (exposure unit) 108, a developing device (developing unit) 112, a primary transfer member (transfer unit) 110, and a cleaning device 116. An endless intermediate transfer belt (hereinafter referred to as an intermediate transfer member) 106 serving as an image bearing member is disposed below the photosensitive drums 105. The intermediate transfer member 106 is stretched around a drive roller 61, a driven roller 62, and a secondary transfer opposing roller 63. The intermediate transfer member 106 is rotatable in a direction indicated by the arrow R2. A secondary transfer roller (secondary transfer member) 114 serving as a transfer unit is disposed so as to be opposed to the secondary transfer opposing roller 63 through intermediation of the intermediate transfer member 106. The intermediate transfer member 106 is nipped between the secondary transfer roller 114 and the secondary transfer opposing roller 63, thereby forming a secondary transfer portion (secondary transfer nip) ST between the secondary transfer roller 114 and the intermediate transfer member 106.

Sheet storage portions (sheet stacking portions) 113 configured to receive the sheet P are disposed in a lower portion of the image forming apparatus 100. The sheets P received in each of the sheet storage portions 113 are fed one by one to a feeding path 117 by a feeding member 115. The sheet P is conveyed to a shift unit (sheet moving unit) 210 through the feeding path 117 by a plurality of conveyance roller pairs (sheet conveying units) 118. In a conveyance direction of the sheet P, the shift unit 210 is disposed upstream of the secondary transfer portion (secondary transfer position) ST of the secondary transfer roller 114. The shift unit 210 is configured to convey the sheet P to the secondary transfer roller 114.

Next, an image forming process of the image forming apparatus 100 will be described. The image forming processes of the four image forming portions 120 are the same, and hence the image forming process of the yellow image forming portion 120Y will be described. The description of the image forming processes of the magenta image forming portion 120M, the cyan image forming portion 120C, and the black image forming portion 120K is omitted.

The charging device 111 uniformly charges a surface of the photosensitive drum 105 to a predetermined surface potential. The light scanning device 108 emits laser light (hereinafter referred to as a light beam), which is modulated in accordance with image information of a yellow component, onto the uniformly charged surface of the photosensitive drum 105. The photosensitive drum 105 is rotated in the rotation direction (sub-scanning direction) indicated by the arrow R1, and the light scanning device 108 scans, with the light beam, the surface of the photosensitive drum 105 along a direction (a main scanning direction) perpendicular to the rotation direction. With this, an electrostatic latent image is formed on the photosensitive drum 105. The developing device 112 develops the electrostatic latent image using yellow toner (coloring material) to form a yellow toner image. The primary transfer member 110 primarily transfers the yellow toner image (visible image) on the photosensitive drum 105 onto the intermediate transfer member 106. The cleaning device 116 removes the toner remaining on the photosensitive drum 105 after the primary transfer.

In the same way, a magenta toner image formed by the magenta image forming portion 120M is accurately transferred onto the yellow toner image on the intermediate transfer member 106 in a superimposed manner. Then, a cyan toner image and a black toner image are sequentially transferred onto the magenta toner image on the intermediate transfer member 106 in a superimposed manner. As a result, the four-color toner images are superimposed on the intermediate transfer member 106.

The sheet P conveyed from the sheet storage portion 113 is conveyed to the secondary transfer roller 114 by the shift unit 210 in synchronization with the toner images on the intermediate transfer member 106. The four-color toner images superimposed on the intermediate transfer member 106 are secondarily transferred onto the sheet P by the secondary transfer roller 114 in a collective manner.

The sheet P having the toner image transferred thereon is conveyed to a fixing processing mechanism. The fixing processing mechanism (fixing unit) of the embodiment includes a first fixing device (first fixing portion) 150 and a second fixing device (second fixing portion) 160 configured to fix the toner image onto the sheet P by heating and pressurizing. The first fixing device 150 includes a fixing roller (fixing member) 151 configured to heat the sheet P, a pressure belt (fixing member) 152 configured to bring the sheet P into press contact with the fixing roller 151, and a sheet sensor 153 configured to detect the sheet P so as to determine whether or not the fixing has been completed. The fixing roller 151 is a hollow roller and has a heater (not shown) therein.

In the conveyance direction of the sheet P, the second fixing device 160 is disposed on a conveyance path 129 downstream of the first fixing device 150. The second fixing device 160 is used for imparting gloss to the toner image fixed on the sheet P by the first fixing device 150 or securing further excellent fixability. Similarly to the first fixing device 150, the second fixing device 160 includes a fixing roller (fixing member) 161, a pressure roller (fixing member) 162, and a sheet sensor 163. The sheet P is not required to be caused to pass through the second fixing device 160 depending on the type of the sheet P. When the sheet P is not caused to pass through the second fixing device 160, the sheet P is conveyed to a conveyance path 130 bypassing the second fixing device 160.

For example, when a setting of imparting the gloss to the sheet P significantly is performed, or a large amount of heat is required for fixing the sheet P as in thick paper, the sheet P passing through the first fixing device 150 is conveyed to the second fixing device 160. On the other hand, when the sheet P is plain paper or thin paper and the setting of imparting the gloss to the sheet P significantly is not performed, the sheet P is conveyed to the conveyance path 130 bypassing the second fixing device 160. Whether the sheet P is conveyed to the conveyance path 129 leading to the second fixing device 160 or conveyed to the conveyance path 130 bypassing the second fixing device 160 is controlled by switching of a flapper 131.

The image forming apparatus 100 is operable in a simplex image forming mode and a duplex image forming mode. In the simplex image forming mode, a toner image transferred on one side (first side) of the sheet P is fixed onto the sheet P by the first fixing device 150 and/or the second fixing device 160, and then the sheet P is delivered to the outside of the image forming apparatus 100. In the duplex image forming mode, the sheet P having the image formed on the one side is reversed between front and back by a sheet reversing portion (sheet reversing unit) 140, and is conveyed to the secondary transfer portion ST again. A toner image is transferred onto the other side (second side reverse to the first side) of the sheet P, and the toner image is fixed onto the sheet P by the first fixing device 150 and/or the second fixing device 160. The sheet P having the images formed on both the sides (first side and second side) is delivered to the outside of the image forming apparatus 100.

The image forming apparatus 100 includes the sheet reversing portion 140 configured to reverse the sheet P having the image formed on the first side between front and back, and to convey the sheet P to the secondary transfer roller 114 again in order to form the images on both the sides of the sheet P. The sheet reversing portion 140 includes a conveyance path switching flapper 132, a conveyance path 135, a reversing portion 136, and a conveyance path 138 for image formation on both sides. The conveyance path switching flapper 132 is a guide member configured to guide the sheet P to the conveyance path 135 or to a delivery path 139 leading to the outside. A leading edge of the sheet P guided to the conveyance path 135 passes through a sheet sensor 137 to be conveyed to the reversing portion 136. When the sheet sensor 137 detects a trailing edge of the sheet P, the conveyance direction of the sheet P is switched. A conveyance path switching flapper 133 is a guide member configured to guide the sheet P to the conveyance path 138 for image formation on both sides or to the conveyance path 135. A conveyance path switching flapper 134 is a guide member configured to guide the sheet P to the delivery path 139 leading to the outside. The sheet P conveyed to the delivery path 139 is delivered to the outside of the image forming apparatus 100. When the sheet P is guided to the conveyance path 138 for image formation on both sides by the conveyance path switching flapper 133, the sheet P is guided to the secondary transfer roller 114 again through the conveyance path 138, to thereby form the image on the second side of the sheet P.

(Block Diagram)

Figure 2:
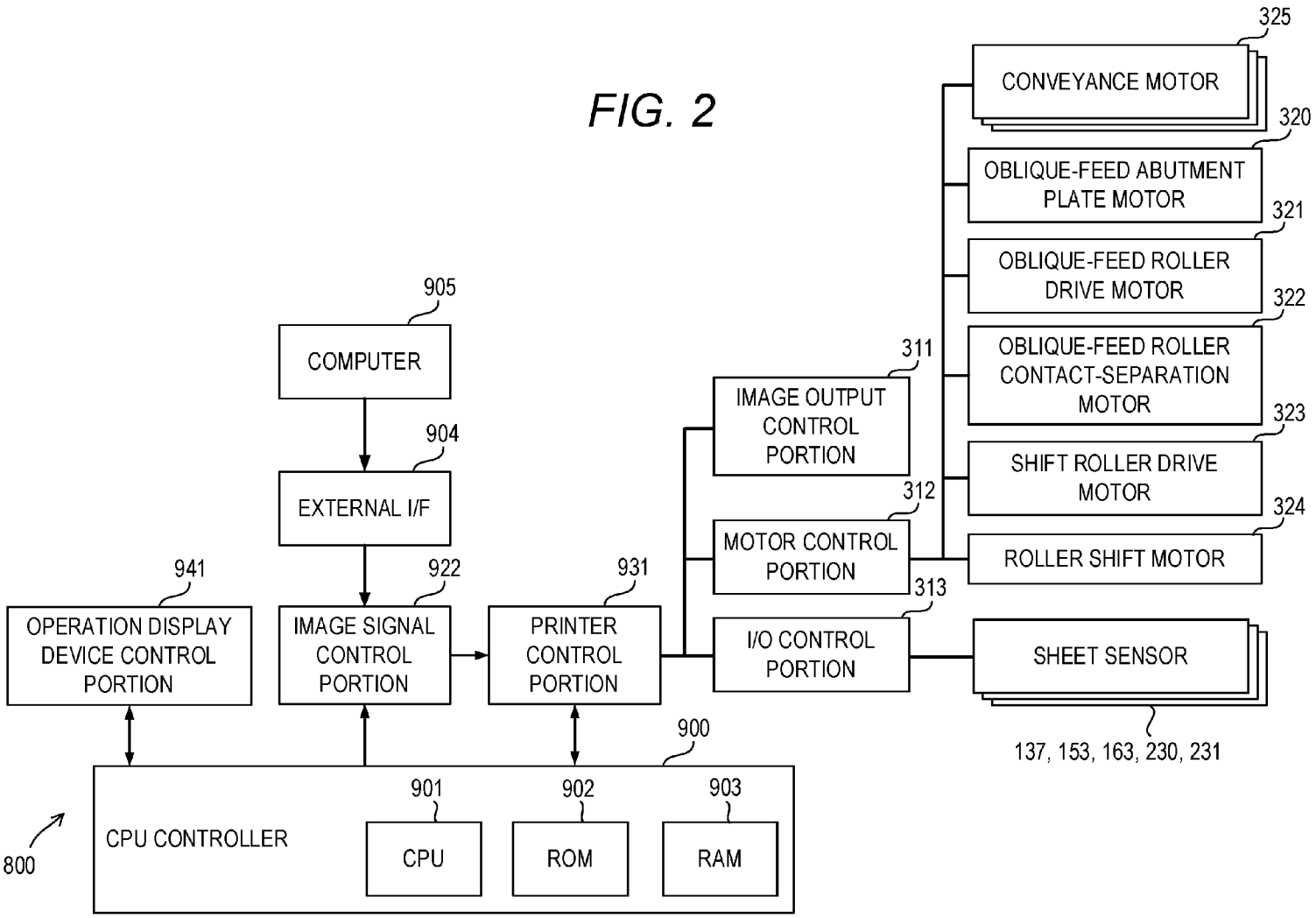
FIG. 2 is a block diagram of a controller configured to control the image forming apparatus.

Next, referring to FIG. 2, a controller 800 configured to control the image forming apparatus 100 will be described. FIG. 2 is a block diagram of the controller 800 configured to control the image forming apparatus 100. As illustrated in FIG. 2, the controller 800 includes a CPU controller 900. The CPU controller 900 has a CPU (controller) 901, a ROM (storage) 902, and a RAM (storage) 903 incorporated therein. The CPU 901 is configured to control an image signal control portion 922, a printer control portion 931, and an operation display device control portion 941 based on control programs stored in the ROM 902. The RAM 903 is configured to temporarily store control data, and is used as a work area for arithmetic processing associated with the control.

An external I/F 904 is connected to a computer 905 provided to the outside of the image forming apparatus 100 so as to be communicable to each other. The image signal control portion 922 is configured to execute various types of processing on digital image signals input from the computer 905 via the external I/F 904 so as to convert the digital image signals into video signals, and output the video signals to the printer control portion 931. The processing operations executed by the image signal control portion 922 are controlled by the CPU controller 900. The CPU controller 900 is configured to execute an image forming operation and various types of adjustment described later via the printer control portion 931. The printer control portion 931 is electrically connected to each of an image output control portion 311 configured to control the light scanning device 108 for each color, a motor control portion 312 configured to drive various motors, and an I/O control portion 313 configured to control I/O of various sensors.

The video signals output from the image signal control portion 922 to the printer control portion 931 are transmitted to the image output control portion 311. The image output control portion 311 can adjust an image writing start position with use of the light beam with which the light scanning device 108 scans the photosensitive drum 105 in the main scanning direction. The image output control portion 311 is configured to set the image writing start position on the photosensitive drum 105 in the main scanning direction in accordance with a shift position of the sheet P, which will be described later.

The motor control portion 312 is configured to control an oblique-feed abutment plate motor 320, an oblique-feed roller drive motor 321, an oblique-feed roller contact-separation motor 322, a shift roller drive motor 323, a roller shift motor 324, and a conveyance motor 325 configured to drive the conveyance roller pairs 118. The I/O control portion 313 is connected to each of the sheet sensors 137, 153, and 163 and sheet sensors 230 and 231. Detection signals output from the sheet sensors 137, 153, 163, 230, and 231 are input to the CPU 901 via the I/O control portion 313 and the printer control portion 931.

(Shift Unit 210)

Next, referring to FIG. 3A, FIG. 3B, and FIG. 4, sheet shift control executed by the shift unit 210 will be described. In this case, the sheet shift control is a control operation in which the CPU 901 controls the shift unit 210 to move the sheet P in directions Y1 and Y2 orthogonal to a conveyance direction X of the sheet P. The directions Y1 and Y2 orthogonal to the conveyance direction X of the sheet P may be hereinafter referred to as width directions Y1 and Y2. The conveyance direction X corresponds to the sub-scanning direction, and the width directions Y1 and Y2 correspond to the main scanning direction. The shift unit 210 can change a position of the sheet P to pass through the fixing roller 151 in the width direction for each conveyed sheet P.

Figure 3A:
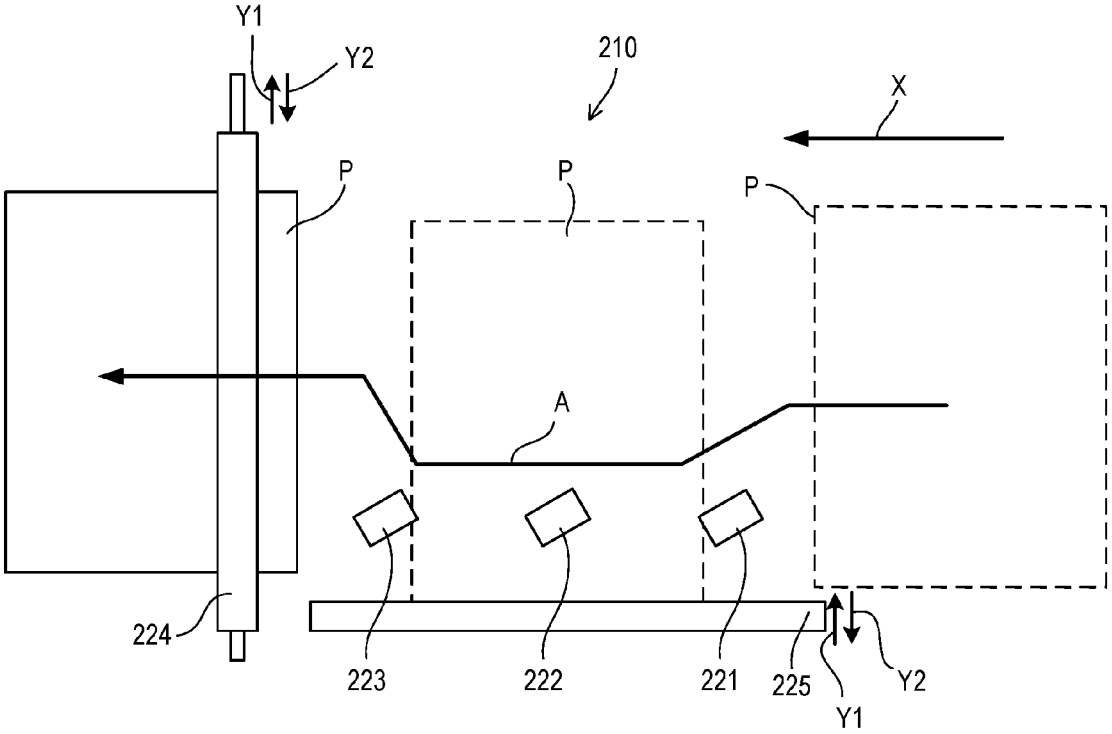
FIG. 3A and FIG. 3B are views for illustrating shift control executed by a shift unit.
Figure 3B:
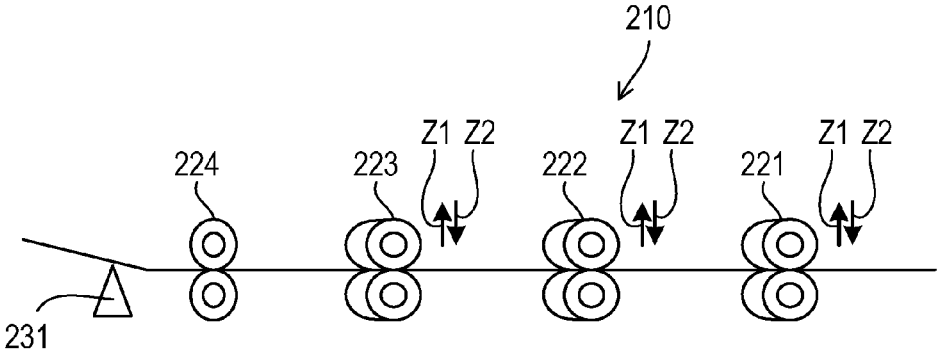

FIG. 3A and FIG. 3B are views for illustrating the sheet shift control executed by the shift unit 210. FIG. 3A is a plan view of the shift unit 210. FIG. 3B is a side view of the shift unit 210. The arrow A in FIG. 3A indicates a moving passage of the sheet P in the shift unit 210.

The shift unit 210 includes shift rollers 224 and the sheet sensor 231. The shift rollers 224 of the shift unit 210 are configured to move the sheet P, which is corrected in skew feed by a corrector configured to correct skew feed of the sheet P, in the width directions Y1 and Y2. The corrector includes oblique-feed rollers (oblique-feed rotary members) 221, 222, and 223 and an oblique-feed abutment plate (movable abutment member) 225. The oblique-feed rollers 221, 222, and 223 are driven by the oblique-feed roller drive motor 321. The oblique-feed rollers 221, 222, and 223 are each a pair of rollers. The oblique-feed roller contact-separation motor 322 is configured to move one or both of the pair of rollers of each of the oblique-feed rollers 221, 222, and 223 in directions Z1 and Z2 perpendicular to a plane of the sheet P, to thereby execute a contact-separation operation of the pair of rollers of each of the oblique-feed rollers 221, 222, and 223. The shift rollers 224 are driven by the shift roller drive motor 323. The shift rollers 224 are a pair of rollers. The pair of rollers of the shift rollers 224 are moved in the width directions (main scanning directions) Y1 and Y2 by a drive mechanism (not shown) to be driven by the roller shift motor (a sheet moving motor) 324.

The oblique-feed abutment plate 225 is configured to correct skew feed of the sheet P through abutment of the sheet P. The oblique-feed abutment plate 225 is movable in the width directions (main scanning directions) Y1 and Y2 by a drive mechanism (not shown) to be driven by the oblique-feed abutment plate motor (abutment member moving motor) 320. The oblique-feed abutment plate 225 is moved in the width direction to a position corresponding to the size of the sheet P in the width direction by the oblique-feed abutment plate motor 320 before start of conveyance of the sheet P. In the embodiment, the oblique-feed abutment plate 225 is moved from a center of conveyance to a position at (sheet width/2+5) [mm]. The sheet width refers to a dimension [mm] of the sheet P in the width direction. Therefore, the center of the sheet P corrected in skew feed by the oblique-feed abutment plate 225 and the oblique-feed rollers 221, 222, and 223 is located at a position shifted by 5 mm from the center of conveyance to the near side (in the direction indicated by the arrow Y2). With this, the shift rollers 224 only need to move the sheet P in one direction from the near side to the far side, which is indicated by the arrow Y1, thereby being capable of suppressing influence of a backlash of the drive mechanism (not shown) to be driven by the roller shift motor 324.

The sheet P conveyed to the shift unit 210 is conveyed in the direction indicated by the arrow X while being moved in the direction indicated by the arrow Y2 by the oblique-feed rollers 221, 222, and 223 to be brought into abutment against the oblique-feed abutment plate 225. A side edge of the sheet P is brought into abutment against the oblique-feed abutment plate 225, thereby correcting skew feed of the sheet P. After the skew feed of the sheet P is corrected, the leading edge of the sheet P is nipped by the shift rollers 224. The pair of rollers of each of the oblique-feed rollers 221, 222, and 223 are separated from one another, and the shift rollers 224 are moved to the far side in the direction indicated by the arrow Y1, thereby correcting the position of the sheet P in the width direction (lateral misregistration). In the embodiment, through the movement of the shift rollers 224, the position of the sheet P in the width direction (lateral misregistration) is corrected, and the sheet shift control for preventing a flaw on the fixing roller is executed.

When side edges of a plurality of sheets P successively pass through the same portion of the fixing roller 151 or the pressure belt 152 in the width direction during successive conveyance of the plurality of sheets P, the surface of the fixing roller or the pressure belt 152 is flawed (chipped) by cut edges at the side edges of the sheets P. The flaw (chip) generated on the surface of the fixing roller 151 or the pressure belt 152 may cause image failure. The sheet P is moved in the width directions (main scanning directions) Y1 and Y2 in order to prevent the generation of the flaw on the surface of the fixing roller 151 or the pressure belt 152. A plurality of positions are set in the width direction, and the sheet P is moved in the width direction to any one of the plurality of set positions (hereinafter referred to as shift positions) every time the sheet P is conveyed.

In the embodiment, five shift positions (0: center, +1: shift to far side by 1 mm, +2: shift to far side by 2 mm, −1: shift to near side by 1 mm, and −2: shift to near side by 2 mm) are set in advance. FIG. 4 is a view for illustrating the shift positions. The CPU 901 serving as a controller is configured to determine the shift position to which the sheet P is to be moved in a shift position determining operation described later.

(Shift Position Determination)

Now, referring to FIG. 5, FIG. 6A, and FIG. 6B, an operation of the CPU 901 to determine the shift position of the sheet P will be described. FIG. 5 is a flowchart for illustrating the shift position determining operation for the sheet P, which is executed by the CPU 901. The CPU 901 is configured to execute the shift position determining operation for the sheet P based on programs stored in the ROM 902. FIG. 6A and FIG. 6B are lookup tables for showing a relationship between the shift position and the number of supplied sheets.

When the shift position determining operation is started, the CPU 901 determines whether or not page print has been demanded (S1001). When the page print has not been demanded (NO in S1001), the CPU 901 waits until the page print is demanded. When the page print has been demanded (YES in S1001), the CPU 901 determines which of the first side and the second side an image for the page demanded for printing is to be formed on (S1002). When it is determined that the image for the page demanded for printing is to be formed on the first side (YES in S1002), the CPU 901 selects the shift position having the least count value of the number of supplied sheets from the lookup table shown in FIG. 6A or FIG. 6B (S1003).

Figures 4, 6A, 6B:
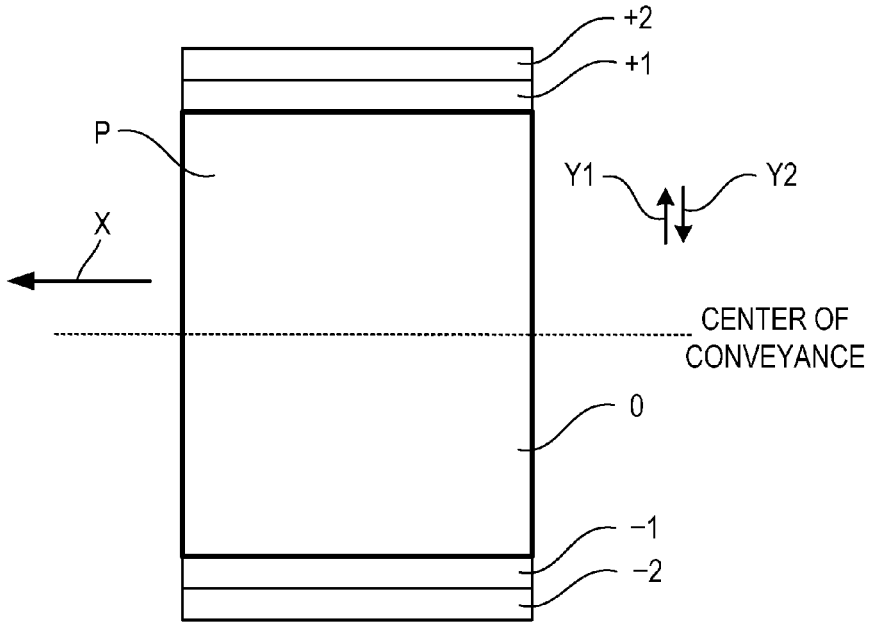
FIG. 4 is a view for illustrating shift positions.
FIG. 6A and FIG. 6B are lookup tables for showing a relationship between the shift position and the number of supplied sheets.
Figure 5:
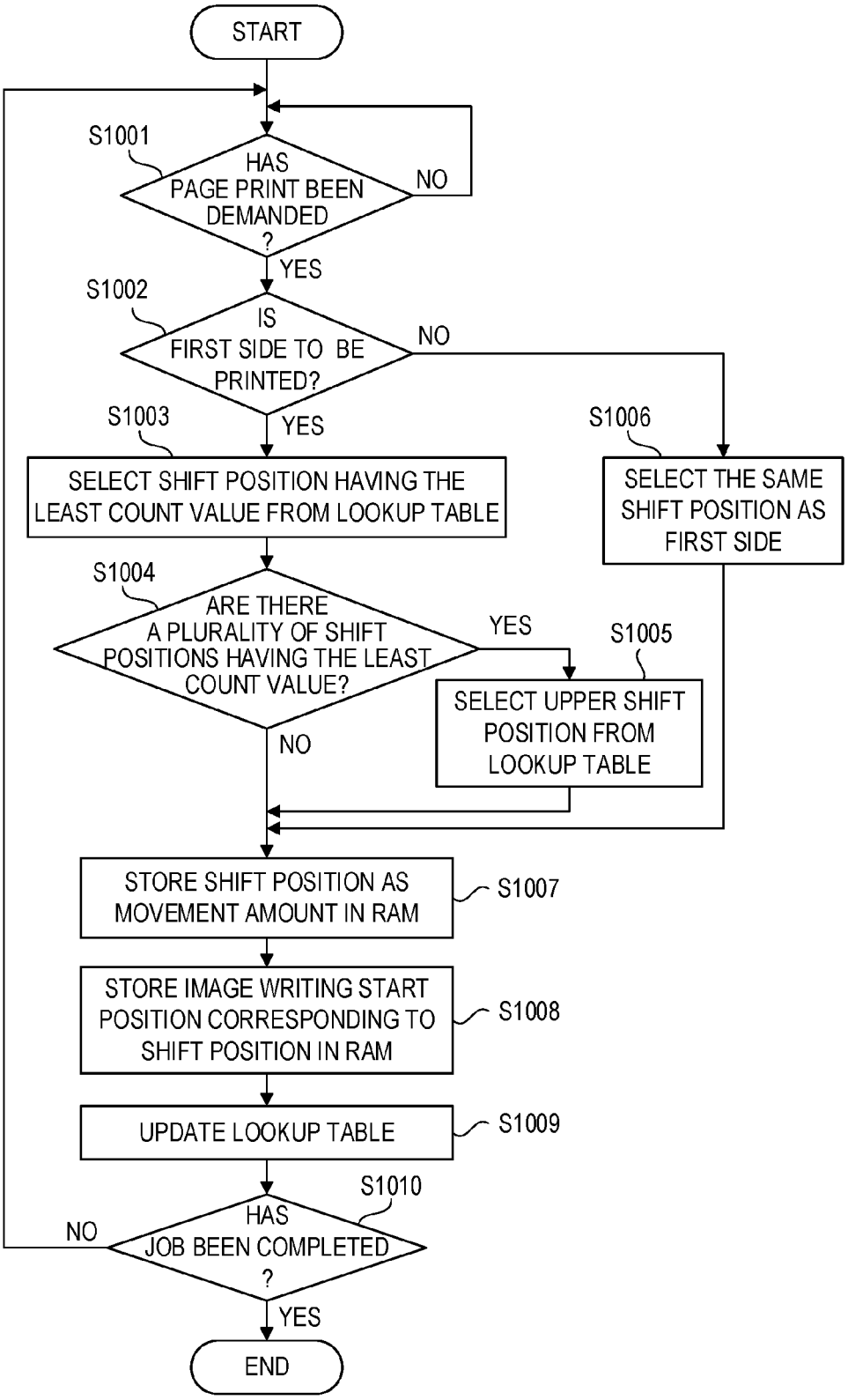
FIG. 5 is a flowchart for illustrating a shift position determining operation for a sheet, which is executed by a CPU.

The lookup table shown in FIG. 6A or FIG. 6B is stored in the RAM 903. The CPU 901 counts the number of supplied sheets P for each shift position, and the count values are stored in the lookup table in the RAM 903. For example, when the lookup table has the count values of the numbers of supplied sheets as shown in FIG. &A, the least count value of 15012 corresponds to only one shift position "+1". In this case, the shift position can be determined uniquely, and thus, the CPU 901 serving as a selection unit selects the one shift position "+1" (S1003). On the other hand, when the lookup table has the count values of the numbers of supplied sheets as shown in FIG. 6B, the least count value of 15013 corresponds to two shift positions "0"

and "−1". In this case, the CPU 901 selects the two shift positions "0" and "−1" (S1003).

The CPU 901 determines whether or not a plurality of shift positions are selected from the lookup table (S1004). When the plurality of shift positions are not selected from the lookup table (NO in S1004), the processing proceeds to Step S1007 while the CPU 901 selects the one shift position in Step S1003. When the plurality of shift positions are selected from the lookup table (YES in S1004), the CPU 901 serving as the selection unit selects the upper shift position in the lookup table from among the plurality of selected shift positions (S1005). For example, when the two shift positions "0" and "−1" are selected in Step S1003 above, the upper shift position in the lookup table is selected (S1005). That is, when the plurality of shift positions each having the least count value of the number of supplied sheets are selected from the lookup table, the CPU 901 serving as the selection unit selects one shift position from among the plurality of shift positions each having the least count value in accordance with a predetermined order.

When it is determined in Step S1002 that the image for the page demanded for printing is not to be formed on the first side (NO in S1002), that is, when it is determined that the image for the page demanded for printing is to be formed on the second side, the processing proceeds to Step S1006. The CPU 901 serving as the selection unit obtains the shift position selected when forming the image on the first side, which is stored in the RAM 903, irrespective of the count value in the lookup table, and selects the same shift position.

The CPU 901 stores the shift position selected in Step S1003, S1005, or S1006 in the RAM 903 as a movement amount (shift amount) of the sheet P in association with page information (S1007). The movement amount is set based on the shift position. The CPU 901 stores an image writing start position in the main scanning direction, which corresponds to the shift position, in the RAM 903 in association with the page information (S1008). The image output control portion 311 adjusts the image writing start position in the main scanning direction with use of the light beam, with which the light scanning device 108 scan the photosensitive drum 105, based on the image writing start position.

The CPU 901 increments, by one, the count value of the number of supplied sheets at the selected shift position, and updates the lookup table stored in the RAM 903 (S1009). The CPU 901 determines whether or not a print job is completed (S1010). When the print job has not been completed (NO in S1010), the CPU 901 repeats the processings in Step S1001 to Step S1009 until the print job has been completed. When the print job has been completed (YES in S1010), the CPU 901 completes the shift position determining operation.

As described above, when the image is to be formed on the first side of the sheet P, the CPU 901 sets the movement amount of the sheet P. Note that, the movement amount may also be set for each sheet P, or may also be set for the plurality of sheets P, such as two or three sheets P.

(Shift Control)

Figure 7A:
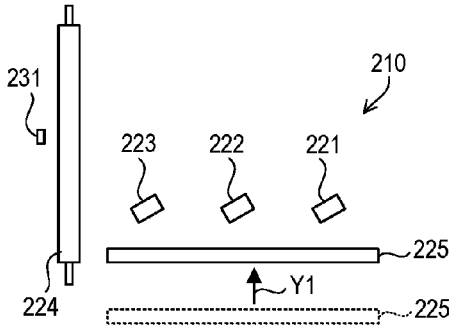
FIG. 7A, FIG. 7B, FIG. 7C, FIG. 7D, FIG. 7E, and FIG. 7F are views for illustrating correction for skew feed of the sheet and the shift control for the sheet, which are executed by the shift unit.
Figure 7B:
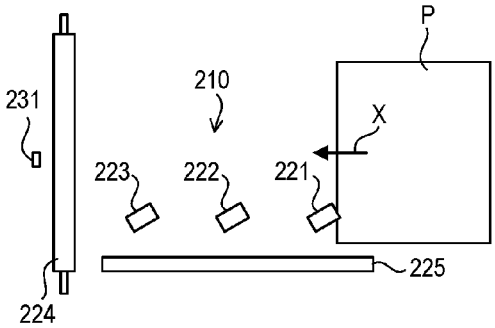

Next, referring to FIG. 7A, FIG. 7B, FIG. 7C, FIG. 7D, FIG. 7E, FIG. 7F, and FIG. 8, shift control for moving the sheet P in the width direction will be described. FIG. 7A to FIG. 7F are views for illustrating correction for skew feed of the sheet P and the shift control for the sheet P, which are executed by the shift unit 210. FIG. 8 is a flowchart for illustrating a shift control operation executed by the CPU 901. The CPU 901 is configured to execute the shift control operation based on programs stored in the ROM 902.

When the shift control operation is started, the CPU 901 determines whether or not the page print has been demanded (S1101). When the page print has not been demanded (NO in S1101), the CPU 901 waits until the page print is demanded. When the page print has been demanded (YES in S1101), the CPU 901 executes control for moving the oblique-feed abutment plate to a position corresponding to the size of the sheet P to be conveyed (S1102). The CPU 901 executes control for driving the oblique-feed abutment plate motor 320 so as to move the oblique-feed abutment plate 225 from the center of conveyance to a position at (sheet width/2+5) mm as illustrated in FIG. 7A based on sheet width information of the page demanded for printing.

The CPU 901 determines whether or not the sheet P has arrived at the shift unit 210 (S1103). The CPU 901 determines that the sheet P has arrived at the shift unit 210 when a predetermined period of time elapses since the sheet sensor 230 (FIG. 1) disposed upstream of the shift unit 210 has detected the leading edge of the sheet P. When the sheet P has not arrived at the shift unit 210 (NO in S1103), the CPU 901 waits until the sheet P arrives at the shift unit 210. When the sheet P has arrived at the shift unit 210 as illustrated in FIG. 7B (YES in S1103), the CPU 901 executes control for driving the oblique-feed roller contact-separation motor 322 so as to bring the pair of rollers of each of the oblique-feed rollers 221, 222, and 223 into contact with one another (S1104).

Figure 7C:
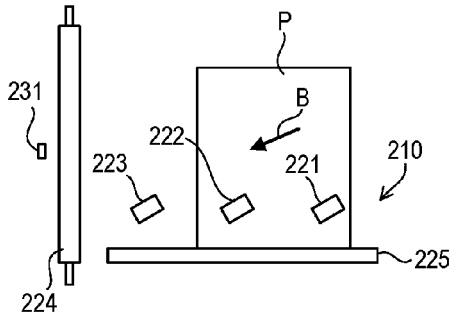
Figure 8:
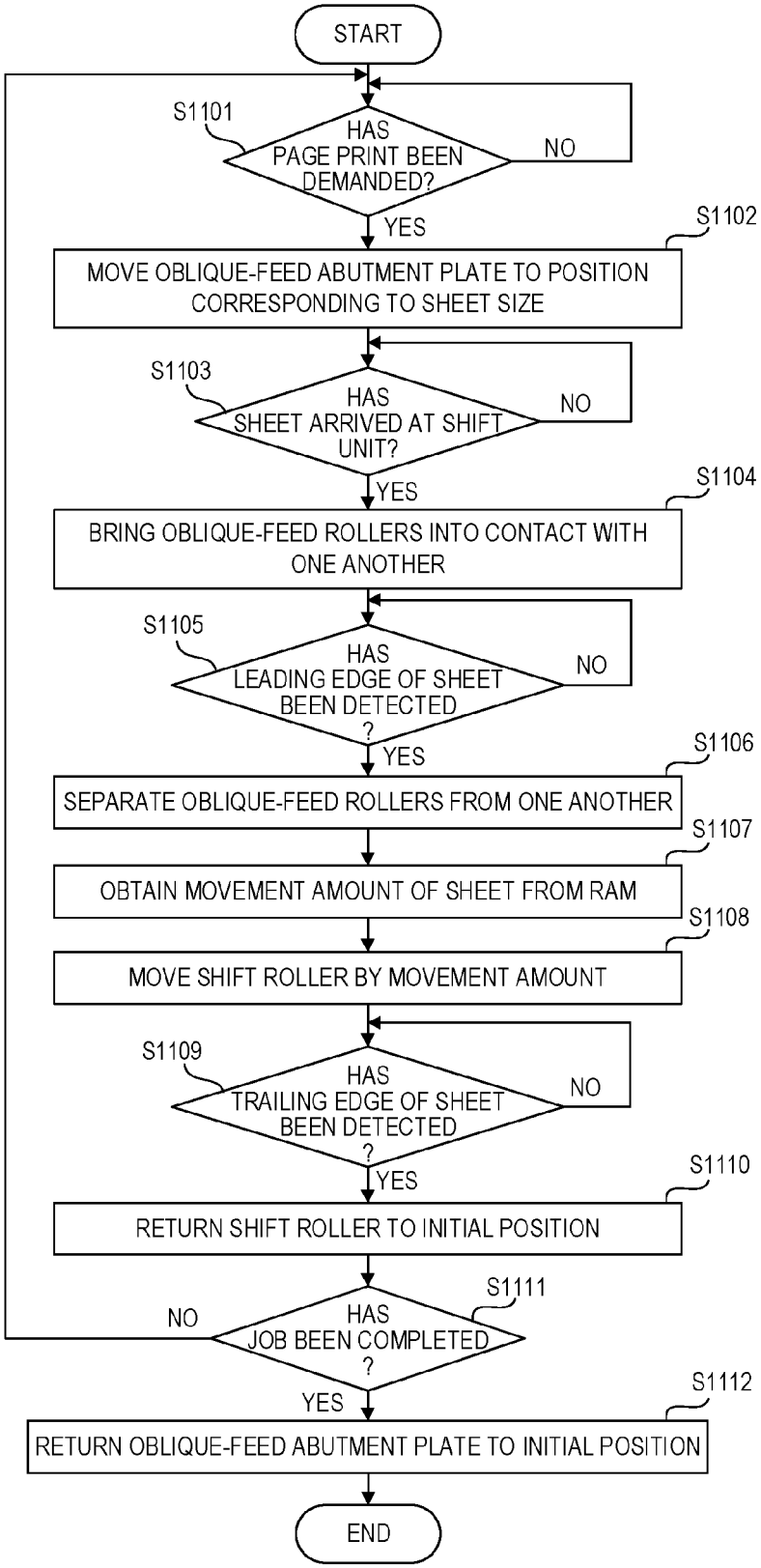
FIG. 8 is a flowchart for illustrating a shift control operation executed by the CPU.

As illustrated in FIG. 7C, the oblique-feed rollers 221, 222, and 223 convey the sheet P in a direction indicated by the arrow B, which is oblique to the conveyance direction X, to bring the sheet P into abutment against the oblique-feed abutment plate 225. The oblique-feed rollers 221, 222, and 223 convey the sheet P while bringing the sheet P into abutment against the oblique-feed abutment plate 225. With this, the side-edge side of the sheet P becomes parallel to the oblique-feed abutment plate 225, thereby correcting skew feed of the sheet P.

Figure 7D:
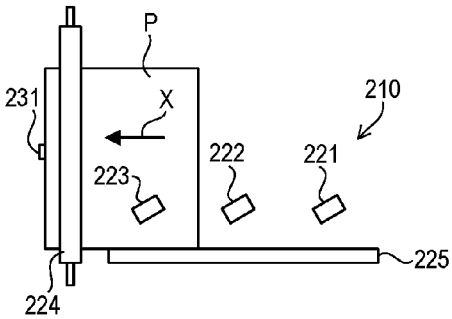

The CPU 901 determines whether or not the sheet sensor 231 disposed downstream of the shift rollers 224 has detected the leading edge of the sheet P (S1105). When the leading edge of the sheet P has not been detected (NO in S1105), the CPU 901 waits until the sheet sensor 231 detects the leading edge of the sheet P. The above-mentioned correction for skew feed of the sheet P is executed until the sheet sensor 231 detects the leading edge of the sheet P since the sheet P has arrived at the shift unit 210. As illustrated in FIG. 7D, when the sheet sensor 231 has detected the leading edge of the sheet P (YES in S1105), the CPU 901 executes control for driving the oblique-feed roller contact-separation motor 322 so as to separate the pair of rollers of each of the oblique-feed rollers 221, 222, and 223 from one another (S1106). The leading edge of the sheet P is nipped by the pair of rollers of the shift rollers 224.

Figure 7E:
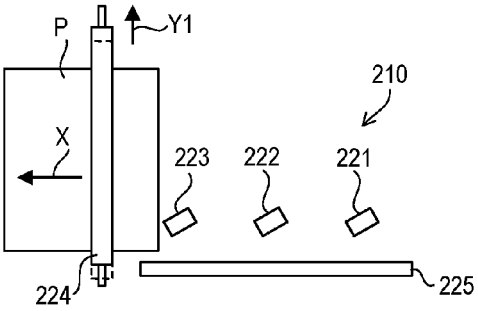

The CPU 901 obtains the movement amount of the sheet P, which is stored in the RAM 903 in Step S1007 in FIG. 5 (S1107). As illustrated in FIG. 7E, the CPU 901 executes control for moving the shift rollers 224 in the width direction Y1 by the movement amount obtained in Step S1107 (S1108). With this, the sheet P is moved in the width direction Y1 to the shift position selected in Step S1003, S1005, or S1006 while being conveyed in the conveyance direction X by the shift rollers 224.

Figure 7F:
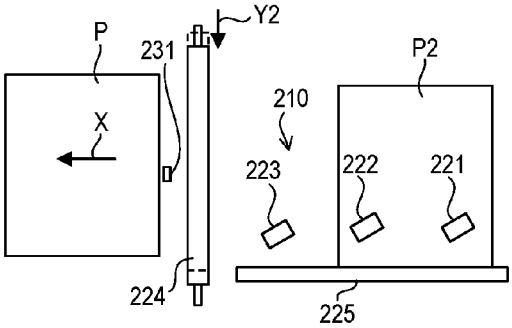

The CPU 901 determines whether or not the sheet sensor 231 has detected the trailing edge of the sheet P (S1109). When the sheet sensor 231 has not detected the trailing edge of the sheet P (NO in S1109), the CPU 901 waits until the sheet sensor 231 detects the trailing edge of the sheet P. Step S1109 is a step in which the CPU 901 waits until the trailing edge of the sheet P passes through the shift rollers 224 before the shift rollers 224 are returned to an initial position. When the sheet sensor 231 has detected the trailing edge of the sheet P (YES in S1109), the CPU 901 determines that the trailing edge of the sheet P has passed through the shift rollers 224. The CPU 901 executes control for driving the roller shift motor 324 so as to move the shift rollers 224 in the width direction Y2 and return the shift rollers 224 to the initial position as illustrated in FIG. 7F (S1110).

The CPU 901 determines whether or not the print job has been completed (S1111). When the print job has not been completed (NO in S1111), the CPU 901 repeats the processings in Step S1101 to Step S1110 until the print job is completed. When the print job has been completed (YES in S1111), the CPU 901 executes control for returning the oblique-feed abutment plate 225 to an initial position (S1112). The CPU 901 completes the shift control operation.

In the image forming apparatus 100 of the embodiment, the shift unit 210 includes the oblique-feed rollers 221, 222, and 223, the shift rollers 224, the oblique-feed abutment plate 225, and the sheet sensor 231. However, the shift unit 210 may not include the shift rollers 224. In this case, it is preferred that the oblique-feed abutment plate 225 be configured to correct skew feed of the sheet P and to move the sheet P in the width direction to the selected shift position. Further, the shift unit 210 may not include the oblique-feed abutment plate 225. In this case, the shift rollers 224 are provided as registration rollers configured to correct skew feed of the sheet P. It is preferred that the shift rollers 224 be configured to correct skew feed of the sheet P and to move the sheet P in the width direction to the selected shift position. Further, the embodiment may also be applied to a conveyance device using an active registration method.

The embodiment is applied to the image forming apparatus 100 configured to transfer the toner image on the intermediate transfer member 106 onto the sheet P. However, the embodiment may also be applied to an image forming apparatus configured to directly transfer the toner image on the photosensitive drum 105 onto the sheet without using the intermediate transfer member 106.

According to the embodiment, when the images are formed on both the sides of the sheet P, the shift position of the sheet P in the width direction when forming the image on the second side can be set to the same shift position selected when forming the image on the first side. Therefore, when the sheet P is moved in the width direction, an error in position of the sheet P in the width direction, which may occur due to a mechanical error of the shift mechanism, can be prevented. Therefore, also in the image forming apparatus configured to execute the shift control for the sheet in order to prevent the flaw on the fixing roller, accuracy of alignment (registration) of image positions between front and back in duplex printing can be enhanced.

According to the embodiment, it is possible to enhance the alignment accuracy between the position of the image on the first side of the sheet and the position of the image on the second side of the sheet even when the sheet is moved in the width direction orthogonal to the conveyance direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-159404, filed Aug. 12, 2015, which is hereby incorporated by reference herein in its entirety.

What is claimed is:

1. An image forming apparatus operable in a simplex image forming mode for forming an image on a first side of a sheet and in a duplex image forming mode for forming images on the first side of the sheet and a second side of the sheet, which is reverse to the first side, the image forming apparatus comprising:

a toner image forming unit configured to form a toner image on an image bearing member;

a sheet conveying unit configured to convey the sheet;

a transfer unit configured to transfer the toner image, which is formed on the image bearing member, onto the sheet conveyed by the sheet conveying unit;

a fixing unit configured to fix, on the sheet, the toner image transferred on the sheet;

a sheet reversing unit configured to reverse the sheet from the first side to the second side of the sheet, the toner image having been fixed on the first side, and to convey the sheet to the transfer unit again in the duplex image forming mode;

a sheet shifter configured to move the sheet in a width direction orthogonal to a conveyance direction of the sheet to be conveyed to the fixing unit;

a controller configured to determine, when a first toner image is to be formed on a first side of a first sheet, based on a plurality of positions to which a plurality of sheets, conveyed before the first sheet, are moved by the sheet shifter, a shift position corresponding to a passing position at which the first sheet is to pass the fixing unit in the width direction; and a memory configured to store, when the first toner image is to be formed on the first side of the first sheet, the shift position of the first sheet determined by the controller, wherein, when a second toner image is to be formed on a second side of the first sheet, the controller controls the sheet shifter such that the first sheet is moved to the shift position of the first sheet stored in the memory regardless of a shift position to which another sheet is moved by the sheet shifter before the second toner image is formed on the second side of the first sheet.

2. An image forming apparatus according to claim 1, wherein the toner image forming unit comprises:

a photosensitive member which is rotatable;

an exposure unit configured to emit a light beam according to image information onto the photosensitive member so as to form an electrostatic latent image on the photosensitive member; and a developing unit configured to develop the electrostatic latent image with toner into the toner image, and wherein the controller determines an image writing start position on the photosensitive member with use of the light beam in a main scanning direction perpendicular to a rotation direction of the photosensitive member in accordance with a determined shift position.

3. An image forming apparatus according to claim 1, wherein the image bearing member comprises an intermediate transfer member, and wherein the transfer unit transfers the toner image, which is formed on the intermediate transfer member, onto the sheet.

4. An image forming apparatus according to claim 2, wherein the image bearing member comprises the photosensitive member, and wherein the transfer unit transfers the toner image, which is formed on the photosensitive member, onto the sheet.

5. An image forming apparatus according to claim 1, wherein the controller determines the shift position when the first toner image is to be formed on the first side of the first sheet, based on count values of numbers of sheets that have been moved at respective shift positions of a plurality of shift positions.

6. An image forming apparatus according to claim 5, wherein the controller determines the shift position of the first sheet based on a least count value among the count values, and wherein, when there are a plurality of shift positions corresponding to the least count value, the controller selects the shift position from among the plurality of shift positions each having the least count value in accordance with a predetermined order.

7. An image forming apparatus according to claim 1, wherein the sheet shifter is disposed upstream of the transfer unit with respect to the conveyance direction.

8. An image forming apparatus operable in a simplex image forming mode for forming an image on a first side of a sheet and in a duplex image forming mode for forming images on the first side of the sheet and a second side of the sheet, which is reverse to the first side, the image forming apparatus comprising:

a toner image forming unit configured to form a toner image on an image bearing member;

a sheet conveying unit configured to convey the sheet;

a transfer unit configured to transfer the toner image, which is formed on the image bearing member, onto the sheet conveyed by the sheet conveying unit;

a fixing unit configured to fix, on the sheet, the toner image transferred on the sheet;

a sheet reversing unit configured to reverse the sheet from the first side to the second side of the sheet, the toner image having been fixed on the first side, and to convey the sheet to the transfer unit again in the duplex image forming mode;

a pair of rollers, disposed upstream of the transfer unit with respect to a conveyance direction of the sheet to be conveyed to the fixing unit, configured to convey the sheet;

a sheet moving motor configured to move the sheet in a width direction orthogonal to the conveyance direction by causing the pair of rollers to be moved in the width direction so as to change a position of the sheet in the width direction;

a corrector, which is disposed upstream of the pair of rollers with respect to the conveyance direction, configured to correct skew feed of the sheet, the corrector comprising an oblique-feed rotary member configured to convey the sheet in a direction oblique to the conveyance direction and an abutment member against which the sheet conveyed by the oblique-feed rotary member is to be brought into abutment;

an abutment member moving motor configured to move the abutment member in the width direction in accordance with a size of the sheet in the width direction; and a controller configured to determine a movement amount of the sheet to be moved by the sheet moving motor for each sheet, wherein the sheet conveyed by the oblique-feed rotary member is brought into abutment against the abutment member so that the skew feed of the sheet is corrected, wherein when an image is to be formed on a first side of a first sheet, the controller sets a first movement amount for the first sheet, wherein, when an image is to be formed on a first side of a second sheet, the controller sets a second movement amount for the second sheet, and wherein, when an image is to be formed on a second side of the first sheet, the controller controls the sheet moving motor such that the first sheet is moved in the width direction by the first movement amount.

9. An image forming apparatus according to claim 5, wherein, when the second toner image is to be formed on the second side of the first sheet, the controller controls the sheet shifter such that the first sheet is moved to the shift position stored in the memory regardless of the count values.

* * * * *